United States Patent [19]

Rathmayr

[11] 4,158,442

[45] Jun. 19, 1979

[54] FUEL INJECTION DEVICE

[75] Inventor: Heinz Rathmayr, Hallein, Austria

[73] Assignee: Friedmann & Maier Aktiengesellschaft, Hallein, Austria

[21] Appl. No.: 838,221

[22] Filed: Sep. 30, 1977

[30] Foreign Application Priority Data

Oct. 4, 1976 [AT] Austria ..... 7378/76

[51] Int. Cl.[2] ..... B05B 1/30

[52] U.S. Cl. ..... 239/88

[58] Field of Search ..... 239/88–92, 239/533.5

[56] References Cited

U.S. PATENT DOCUMENTS

| | | | |
|---|---|---|---|
| 2,401,579 | 6/1946 | Miller | 239/90 |
| 3,567,133 | 3/1971 | Gewinner | 239/89 |

*Primary Examiner*—Robert W. Saifer

*Attorney, Agent, or Firm*—Cushman, Darby & Cushman

[57] ABSTRACT

The invention relates to a fuel injection device comprising an injection pump and an injection nozzle, the nozzle having a spring-loaded control pin and being assembled together with the pump to form a unit insertable into the wall of a cylinder of an injection type internal combustion engine. The device includes a pump piston, a piston sleeve and a pump housing, the housing enclosing the piston sleeve, the return spring action on the piston, and the regulating jacket acting on the piston. The housing is attachable to the engine housing by tightening screws having axes parallel to the piston sleeve, and the said injection nozzle is tightened by a sleeve nut to an element of the piston sleeve.

2 Claims, 3 Drawing Figures

FUEL INJECTION DEVICE

Figure 1:
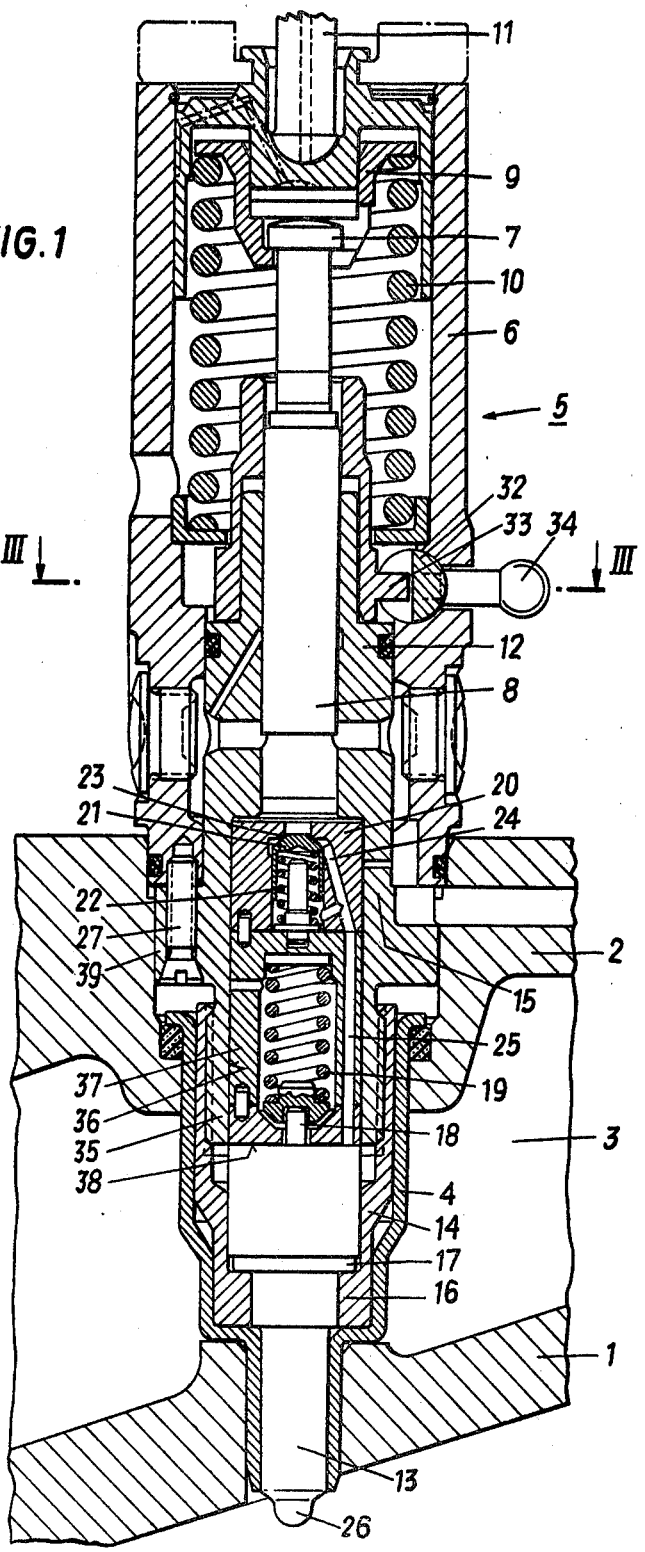

This invention relates to a fuel injection device comprising an injection pump and an injection nozzle, said nozzle having a spring-loaded control pin and being assembled together with said pump to form a unit insertable into the wall delimiting the cylinder of an injection type internal combustion engine, said device comprising further a pump piston, a piston sleeve for said pump piston, and a housing for said injection pump, in said housing being enclosed the piston sleeve, the return spring action on the pump piston, and the regulating jacket acting on the pump piston, said housing of the injection pump being attachable to the engine housing by tightening screws whose axes are parallel to said piston sleeve, whereas said injection nozzle is tightened by a sleeve nut to an element comprising said piston sleeve.

The injection pressure is effective between the injection nozzle and the piston sleeve of the pump piston. Conventionally, the nozzle is connected to the element comprising the piston sleeve by mediation of the injection pump housing which therefore is subject to an extremely high strain. This is a disadvantage since the material used for the injection in general has a lower strength than those materials have from which the elements comprising the piston sleeve are made. On the other hand, making the pump housing from a high-strength material would involve a very expensive production process.

In the prior art there are to be found proposals of tightening the injection nozzle directly to the element comprising the piston sleeve by means of a sleeve nut. With this known arrangement, the nozzle pin spring is contained within a bore of the element comprising the piston sleeve, and the fuel supplied by the pumping piston has to be supplied immediately into the box which contains the nozzle pin spring. By structure reasons it is not possible to interpose a pressure valve. This causes the drawbck that combustion gases can enter the cylinder volume of the pump piston when the nozzle pin sticks in the valve chamber. If this occurs, fuel supplying to the nozzle may be difficult or even impossible. In known embodiments of the kind the element comprising the piston sleeve is also tightened to the injection pump housing by a sleeve nut.

If an injection device of the above described structure is to be inserted into the cylinder wall of an internal combustion engine, the injection pump housing is exposed to a high temperature. As a consequence of the fact that the material of this housing has another coefficient of thermal expansion than has the material from which the piston sleeve is made, thermal tension forces of high degree are generated at the connection areas. This again causes a dangerous new strain in the injection pump housing. Apart from this, the tightening between said housing and said element must be disconnected when repairing work is to be fulfilled.

It is an object of the invention to overcome the above-mentioned drawbacks. The present invention is essentially characterized in that the injection nozzle is tightened by the sleeve nut to said element comprising the piston sleeve in a manner known per se with interposition of a pressure valve housing and a box containing said nozzle pin spring, further characterized in that the injection pump housing is tightenable to the housing of the engine with interposition of said element comprising said piston sleeve, that the injection pump housing abuts as known per se against a flange of said element comprising said piston sleeve, and that the injection pump housing is secured in relation to said element in a predetermined angle position and connected to said element only for shipping and storage purposes preferably by at least one fixing screw provided in an eccentrical position.

According to the invention, the nozzle pin spring is not immediately inserted into a bore of the element comprising the piston sleeve but into a separate box. This allows to interpose a pressure valve housing between the piston sleeve and the box containing the nozzle spring. Thus the superiority of a pressure valve is utilized in a device where the nozzle is tightened to the piston sleeve comprising element. The superiority consists in that combustion gases are hindered from entering the pump cylinder. By interposing the pressure valve housing and the nozzle spring box between the injection nozzle and the piston sleeve comprising element, all component parts which are exposed to the high injection pressure are immediately combined to a pressure resistant unit. According to the invention this unit composed of the element comprising the piston sleeve, the pressure valve housing, the nozzle spring box, and the injection nozzle is connected to the housing of the engine by means of tightening screws engaging the housing of the injection pump. By this improvement the operational connection of the said unit to the injection pump housing is secured and a tightening screw joint or improper fastening as well as dangerous thermal tension forces arising therefrom are avoided. Only for shipping and storage purposes the unit must be connected to the pump housing in order to prevent the parts from disconnecting themselves. By fixing the unit in a predetermined angular position with respect to the pump housing the proper angular position of the pump piston with respect to the piston sleeve is secured. The relative angular position of the injection pump housing with respect to the aforementioned unit as well as a provisional connection sufficient for shipping and storage can be secured in a simple manner by abutting the pump housing against a flange provided on the element comprising the piston sleeve and by connecting these two parts by an eccentrically positioned screw.

In a preferred embodiment the invention provides that the element 15 comprising said piston sleeve 12 is provided with a bore 36 coaxial to said piston sleeve 12 and receiving the pressure valve housing 20 and the nozzle spring box 37.

It is useful to provide the same diameter for the box containing the valve pin spring and for the adjacent front face of the injection nozzle, and preferably also for the pressure valve housing. Thus a simple construction is achievable. The injection nozzle is prevented from contacting directly the element comprising the piston sleeve. So the tension force is transmitted from the injection nozzle to the element comprising the piston sleeve through the nozzle pin, the spring box, and the pressure valve housing. A compact interconnection of all these parts is secured.

The injection pump housing may be provided with ears projecting from opposed sides and receiving the tightening screws. Thus no additional element is needed to connect the injection pump housing with the housing of the internal combustion engine.

Figure 2:
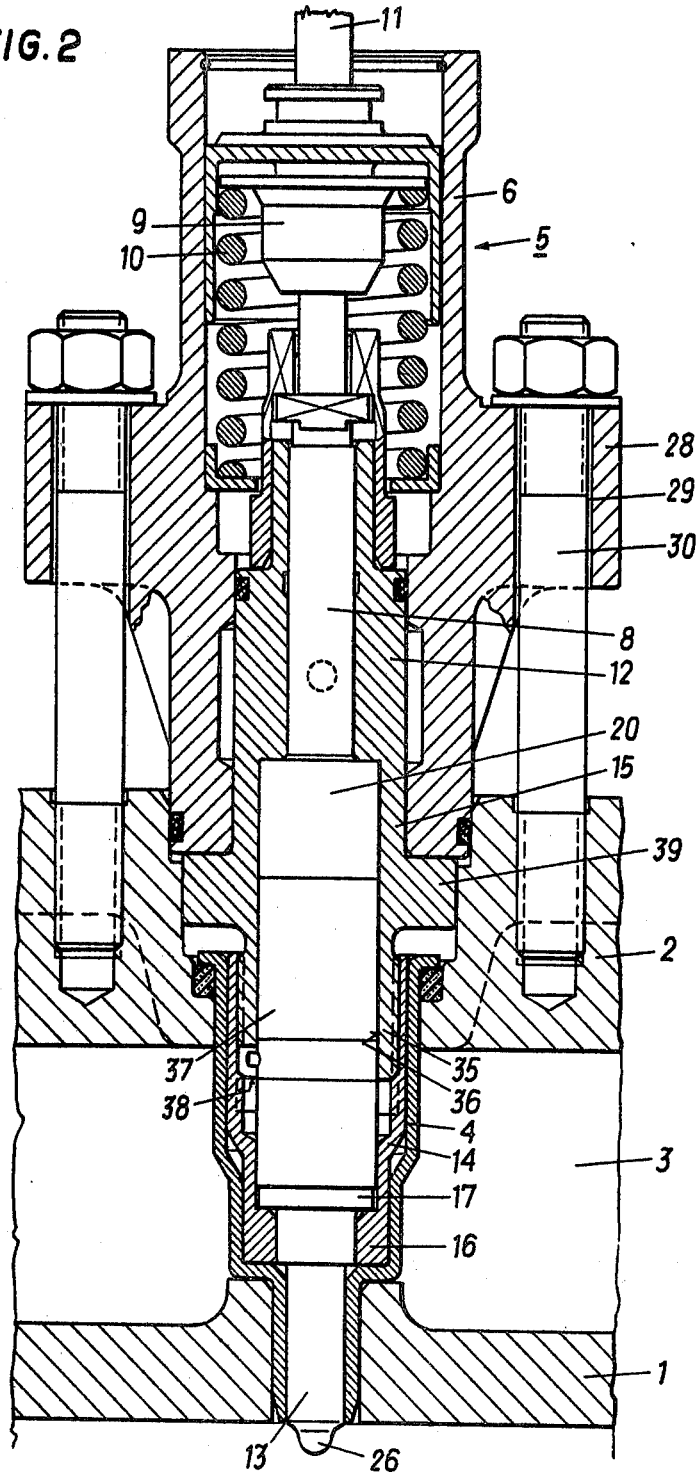
Figure 3:
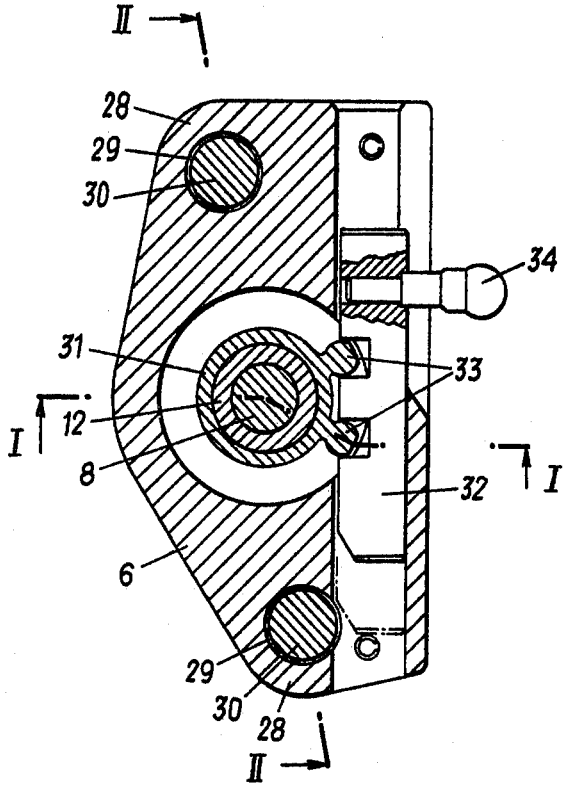

Now the invention shall be described in detail with reference to the accompanying drawings in which FIG. 1 shows an axial section following the line I—I of FIG. 3, FIG. 2 shows a sectional view following the line II—II of FIG. 3, and FIG. 3 shows a cross-section along the line III—III of FIG. 1.

A wall 1 delimits the working cylinder of the internal combustion engine whose housing is indicated by 2. Cooling water is contained in the chamber 3. A casing 4 surrounding the injection device 5 is tightly inserted into the cooling water chamber 3. The housing 6 of the device 5 is provided with two radially projecting eyes 28. Each of the eyes 28 receives in a bore 29 a screw bolt 30 screwed into the engine housing 2 and connecting together the housing 6 of the device with the housing 2 of the engine. A return spring 10 acts on a spring collar 9 which in turn engages the piston head 7 of the pumping piston 8. The piston 8 is guided in a piston sleeve 12 and actuated by a push rod 11. A short controlling rod 32 is provided with a ball bearing plug 34 and engages some cylindrically shaped extensions 33 attached to a regulating jacket 31. Said ball bearing plug 34 is actuated by the regulating member.

The injection nozzle 13 is connected by a sleeve nut 14 to an element 15 comprising the piston sleeve 12. The nut 14 has an inwardly projecting rim 16 which engages a shoulder 17 provided on the nozzle 13. The element 15 is provided with an external screw thread 35 for receiving the nut 14.

A nozzle pin spring 19 is acting on the nozzle pin 18 of the injection nozzle 13.

A bore 36 is provided in the element 15 comprising the piston sleeve 12. Bore 36 is coaxial to the piston sleeve 12. A pressure valve housing 20 is inserted into the bore 36. A valve spring 22 is acting on the valve cone 21 of the pressure valve. A spring box 37 containing the nozzle spring 19 is inserted in the same bore 36. The valve cone 21 opens the conduit to the injecting nozzle 13 upon the influence of the fuel pressure in the stroke volume of the piston 8. The fuel flows through openings 24 and 25 to the orifice 26 of the nozzle 13.

The pressure valve housing 20 and the nozzle spring box 37 have identical diameters. The same diameter is foreseen for the adjacent front face 38 of the nozzle 13. Thus the force issued from the sleeve nut 14 is transmitted to the element 15 by mediation of the nozzle 13, the box 37, and the housing 20.

A flange 39 is connected to the pump housng 6 by means of an eccentrically positioned fixing screw bolt 27. The screw bolt 27 is foreseen only for shipping and storage purposes in order to hold together the housing and the constructional unit composed by the nozzle 13, the box 37, the valve housing 20, and the piston sleeve 12. Additionally, the screw bolt 27 serves to secure the angular position of said unit with respect to the housing 6 whereby also the proper angular position of the piston 8 is maintained.

In operational condition, the screw bolts 30 connect the unit 13 - 37 - 20 - 15 to the housing 6, so that the bolt 27 no longer receives any forces. In assembled state, a seal ring inserted in the housing 6 prevents combustion gases from escaping.

I claim:

1. A fuel injection device comprising an injection pump and an injection nozzle, said nozzle having a spring-loaded control pin and being assembled together with said pump to form a unit insertable into the wall delimiting the cylinder of an injection type internal combustion engine, said device comprising further a pump piston, a piston sleeve for said pump piston, and a housing for said injection pump, said piston sleeve being enclosed in said housing, the return spring acting on the pump piston, and the regulating jacket acting on the pump piston, said housing of the injection pump being attachable to the engine housing by tightening screws whose axes are parallel to said piston sleeve, whereas said injection nozzle is tightened by a sleeve nut to an element comprising said piston sleeve, said device being characterized in that the injection nozzle is tightened by the sleeve nut to said element comprising the piston sleeve in with interposition of a pressure valve housing and a box containing a nozzle pin spring, further characterized in that the injection pump housing is tightenable to a housing of an engine with interposition of said element comprising said piston sleeve, that the injection pump housing abuts against a flange of said element comprising said piston sleeve, and that the injection pump housing is secured in relation to said element in a predetermined angle position and connected to said element only for shipping and storage purposes preferably by at least one fixing screw provided in an eccentrical position.

2. A fuel injection device as defined in claim 1, further characterized in that the element comprising said piston sleeve is provided with a bore coaxial to said piston sleeve and receiving the pressure valve housing and the nozzle spring box.

* * * * *